US007056100B2

(12) United States Patent
Schwarzkopf et al.

(10) Patent No.: US 7,056,100 B2
(45) Date of Patent: Jun. 6, 2006

(54) PISTON ASSEMBLY FOR A COMPRESSOR

(75) Inventors: Otfried Schwarzkopf, Ludwigsburg (DE); Markus Reuβ, Ludwigsburg (DE)

(73) Assignee: Zexel Valeo Climate Control Corporation, Kohnan-Machi (JP)

( * ) Notice: Subject to any disclaimer, the term of this patent is extended or adjusted under 35 U.S.C. 154(b) by 45 days.

(21) Appl. No.: 10/347,579

(22) Filed: Jan. 17, 2003

(65) Prior Publication Data

US 2003/0140779 A1 Jul. 31, 2003

(30) Foreign Application Priority Data

Jan. 17, 2002 (EP) ..... 02001262

(51) Int. Cl.
*F04B 1/12* (2006.01)

(52) U.S. Cl. ..... 417/269; 91/499; 92/71; 92/177; 92/165 R

(58) Field of Classification Search ..... 417/269; 91/499; 92/71, 165 PR, 177
See application file for complete search history.

(56) References Cited

U.S. PATENT DOCUMENTS

| | | | | |
|---|---|---|---|---|
| 5,518,374 | A * | 5/1996 | Ota et al. | 417/222.2 |
| 5,706,716 | A * | 1/1998 | Umemura | 92/165 PR |
| 5,720,215 | A | 2/1998 | Asplund et al. | 92/71 |
| 5,975,860 | A * | 11/1999 | Obayashi et al. | 417/223 |
| 6,030,184 | A * | 2/2000 | Ikeda et al. | 417/269 |
| 6,123,728 | A | 9/2000 | Brosnahan et al. | 623/20.24 |
| 6,220,146 | B1 * | 4/2001 | Ota et al. | 92/165 PR |
| 6,235,031 | B1 | 5/2001 | Hodgeman et al. | 606/64 |
| 6,296,666 | B1 | 10/2001 | Gardner | 623/20.29 |
| 6,325,599 | B1 * | 12/2001 | Herder et al. | 417/269 |

(Continued)

FOREIGN PATENT DOCUMENTS

DE 196 21 174 A1 11/1997

(Continued)

OTHER PUBLICATIONS

European Search Report dated Feb. 20, 2003.

(Continued)

*Primary Examiner*—Tae Jun Kim
*Assistant Examiner*—Emmanuel Sayoc
(74) *Attorney, Agent, or Firm*—Andrus, Sceales, Starke & Sawall, LLP

(57) ABSTRACT

A compressor for a vehicle air conditioning system comprises a front casing in which is mounted a swash or wobble plate arrangement operatively connected to a drive shaft and a plurality of pistons each provided with a piston body at one end and a foot portion at its other. A cylinder block is also provided defining a plurality of cylinder bores equally distributed circumferentially around the drive shaft, in each of which bores one of the piston bodies can be reciprocated by the swash or wobble plate, as the drive shaft rotates. The inner wall surface of the front casing defines a plurality of longitudinally extending recesses in positions apposed to each piston. The piston body and the foot portion of each piston are connected by a bridge that is bending resistant and projects outwardly into these apposed recesses. Also, at least one side of the bridge is provided with a laterally projecting wing that supports the piston against the adjacent inner wall surface of the front casing to one side of the recess. The front casing and the pistons are thus designed for mutual interengagement and, in the piston, the requirement to provide a bending resistant portion has been divided away from the requirement to provide an anti-rotation locking arrangement.

13 Claims, 5 Drawing Sheets

U.S. PATENT DOCUMENTS

| | | | | |
|---|---|---|---|---|
| 6,367,368 | B1 * | 4/2002 | Ganster et al. | 92/71 |
| 6,422,128 | B1 * | 7/2002 | Ahn | 92/71 |
| 6,739,236 | B1 * | 5/2004 | Kato et al. | 92/71 |
| 2003/0044292 | A1 * | 3/2003 | Shinna | 417/269 |

FOREIGN PATENT DOCUMENTS

| | | | |
|---|---|---|---|
| DE | 198 33 604 | A1 | 2/1999 |
| DE | 199 47 347 | A1 | 4/2000 |
| EP | 0 740 076 | B1 | 10/1996 |
| EP | 0 864 306 | A2 | 9/1998 |
| EP | 1 134 411 | A2 | 9/2001 |
| EP | 1 167 758 | A1 | 1/2002 |
| GB | 2 345 446 | A | 7/2000 |
| JP | 2001-238892 | | 9/2001 |
| WO | WO 99/13804 | | 3/1999 |
| WO | WO 01/68002 | A1 | 9/2001 |

OTHER PUBLICATIONS

European Search Report dated Jun. 17, 2002.

* cited by examiner

PISTON ASSEMBLY FOR A COMPRESSOR

FIELD OF THE INVENTION

The present invention relates to a swash or wobble plate compressor, in particular a $CO_2$ compressor; for a vehicle air-conditioning system, and to piston for use in such a compressor.

BACKGROUND OF THE INVENTION

Currently, there are two main trends in the design and manufacture of compressors for use in vehicle air-conditioning systems. These are the use of the more environmentally friendly carbon dioxide ($CO_2$) as a refrigerant to replace tetrafluoroethane (R134a) and the refrigerant for smaller, lightweight compressors which take up as little space and have as low a weight as possible. The latter trend arises as a result of the desire to produce smaller and lighter vehicles which are more fuel efficient. It is also a requirement that the compressor itself be energetically efficient.

In essence, the two trends conflict because the use of $CO_2$ as the refrigerant in the compressor requires it to operate at a higher pressure than a conventional system using R134a as a refrigerant and this leads to the requirement for the compressor to be made from high pressure components, such as steel, which is heavier than materials such as aluminum that can be used to manufacture compressors for use at lower pressures. If aluminum is used for the casing of a high pressure compressor then the wall thickness of the casing must be increased. Also, in high pressure compressors the casing must be adequately sealed.

DE 19621174 describes a compressor suitable for use with $CO_2$ as the refrigerant in which a casing defining a cylinder block is sealed on its drive shaft side by an end member which is screwed to the casing by a large number of small diameter bolts. By using smaller bolts, the diameter of the screw holes in the wall of the casing can be kept small and the wall of the casing can therefore be made thin. However, the design of the casing is such that the driving mechanism of the compressor and the pistons especially are difficult to mount. Also, despite the compact design of the compressor and the thin wall of the casing, the casing and the pistons were made of steel.

DE 19833604 similarly describes a compressor for use with $CO_2$ as the refrigerant which is also made of high-strength materials such as high pressure steel, bronze alloy and the like. To keep the weight of the compressor to a minimum, its casing has a low wall thickness but this does not allow screws or bolts to be secured therein. Accordingly, in this compressor, the bolting arrangements of the casing to an end member is made by passing bolts through casing and into the cylinder head. However, this requires mounting space to be provided. The cylinder head of a compressor must provide a certain volume in order that suction and pressure gas pulses are reduced. Also, various functions of the compressor, such as the regulation of the compressor and oil, separation take place in the cylinder head. Consequently, the compressor in question tends to be bulky. The weight of the compressor is also added to by the fact that a considerable number of very lengthy bolts is required. A further drawback of the compressor is that each bolt must be individually sealed because its head projects out of the casing.

A similar arrangement is described in DE 19947347.

It will be appreciated with such compressors that if, to reduce weight, the casing is made from an aluminum problems will arise with regard to sealing when the compressor heats up and cools down because the length of the bolts, which must of necessity be made from steel, causes them to expand and to contract at a different rate to the casing. As sealing of particularly high pressures in the vicinity of the bold head is required, this problem can be severe.

A further problem arises in swash or wobble plate compressors relating to the requirement to prevent the plates from rotating during use. A conventional piston 1, as shown in FIG. 1, for use in such a compressor typically comprises a body 2 with a head portion 3 at one end for reciprocation in a bore and a foot portion 4 at its other end. A neck or bridge 5 links the foot portion 4 to the body 2 so that a recess 6 is defined between foot portion 4 and body 2. Recess 6 is intended to accommodate a bearing of a swash or wobble plate arrangement by which means the piston is reciprocated.

Conventionally, body 2 of the piston has a circular transverse cross-sectional profile, as does the bore in which it reciprocates. This necessitates the use of an anti-rotation lock to prevent any significant rotation of the piston about its longitudinal axis. Various mechanisms have been used to this end. For example, the body of the piston can be provided with a spine or ridge which projects longitudinally along its length and which reciprocates within a similarly extending and matching groove in the wall of the bore. In EP 0740076 it is proposed that the bridge of the piston be enlarged so that it defines a convex outer wall apposed to the concave wall portion of the casing next to which it reciprocates. The radius of the convex face of the bridge is made greater than the radius of the cylindrical body of the piston but smaller than the internal concave wall of the casing. Consequently, owing to contact between the enlarged bridge portion and the inner wall surface of the casing which occurs as a result of rotation of the piston during use, the actual degree of the rotation is limited. In fact, only an edge or spot of the convex face of the bridge of the piston contacts the wall of the casing. Also, the further this edge is from the longitudinal axis of the cylindrical body of the piston, the longer is the theoretical lever arm and therefore the lower is the bearing stress for supporting the piston rotation. This keeps the frictional forces caused by the contact between the piston and the casing wall low. However, it will be appreciated that the contacting surfaces should be treated to reduce friction and wear so far as is possible.

In U.S. Pat. No. 6,325,599 an anti-rotation piston for a swash plate compressor is described that includes a pair of opposed anti-rotation wings that extend radially from one end of the body adjacent the bridge. The wings prevent rotation of the piston as they contact the wall of the casing. However, this arrangement has the significant disadvantage that the guide length of the piston body is reduced.

BRIEF SUMMARY OF THE INVENTION

The object of the present invention is to provide a compressor and a piston for use in such a compressor in which anti-rotation locking is provided but which also enables the compressor to be made small and lightweight, with a front casing that has a wall thickness optimized in the respect of its weight and bulk. The aforementioned problems described initially with regard to the size of a compressor for use with $CO_2$ as the refrigerant can therefore also be mitigated.

According to a first aspect of the present invention there is provided a compressor for a vehicle air conditioning system comprising a drive shaft; a plurality of pistons each provided with a piston body at one end and a foot portion at its other end; a front casing with an inner wall surface defining a plurality of longitudinally extending recesses in positions apposed to each piston; a swash or wobble plate arrangement mounted in the front casing and operatively connected to the drive shaft; a cylinder block defining a plurality of cylinder bores equally distributed circumferentially around the drive shaft, in each of which bores one of the piston bodies can be reciprocated by the swash or wobble plate arrangement as the drive shaft rotates; the piston body and the foot portion of each piston being connected by a bridge that is being resistant and projects outwardly into the apposed recess; and a laterally projecting wing being provided on at least one side of the bridge of each piston to support said piston against the adjacent inner wall surface of the front casing to one side of the recess.

It will thus be appreciated that the advantage provided by the present invention resides in the fact that the front casing and the pistons are designed for mutual interengagement. This enables considerable space-saving in the design of the compressor. Also, the position of the wings on the bridge means that the piston guide length is not shortened. In addition, in the piston the requirement to provide a bending resistant portion has been divided away from the requirement to provide an anti-rotation locking arrangement and thus enables the piston to be optimally designed for each function rather than a compromise design being necessary. This also has an advantageous repercussion on the front casing in as much that it can be divided into different functional areas which interact with the piston in different ways. This means that the front casing is easier to machine internally and to assemble. Furthermore, the wings contribute to the strength of the bridge and their position keeps reaction forces low because the wings lie in an outer region of the piston rather than on the piston body, as in the prior art configuration described above.

The wing preferably projects laterally from along the full length of the bridge and is preferably integrally formed with the bridge.

Preferably also, the external profile of the enlarged bridge is fashioned with a diameter which is greater than the diameter of the outer external profile of the wing. Advantageously, this profile is centered on the longitudinal axis of the front casing.

Preferably also, the wall surface of the front casing defining each recess is not contacted by the apposed bridge.

Preferably also, the diameter of the external profile of the enlarged bridge is greater than the smallest inner wall diameter of the front casing.

The enlarged bridge is dimensioned in such a way as to resist the bending moments that act on the piston during use of the compressor. In contrast, the wing, which does not have to resist the bending moments, can be made thinner than the enlarged bridge thus saving material and weight in the compressor.

Preferably, the diameter of the outer external profile of the wing is substantially the same as the diameter of the adjacent inner wall surface against which it is supported.

Advantageously, both sides of the bridge are symmetrically provided with a projecting wing.

Such a design of anti-rotation locking enables a large theoretical lever arm to be provided, which reduces the reaction force and thereby reduces the frictional forces produced.

Preferably also, the portions of the front casing between the recesses are provided with longitudinally extending bores in which fasteners can be located to attach the front casing to the cylinder block.

In this way, the fasteners are accommodated in a manner which does not increase the overall outer diameter of the front casing, which helps to minimize the size of the compressor.

Preferably also, the bores extend completely through the portions of the front casing between the recesses and are open at both ends.

Preferably also, the depth of the recesses is such that a constant stress distribution is achieved over the circumference of the front casing on the alternating recesses and bores.

Preferably also, the front casing is of unitary "cup-shaped" construction. Alternatively, it comprises at least two separate but interconnected portions. In either case its shape is such that it can be easily manufactured at low cost.

Advantageously, the front casing comprises a hollow cylindrical body portion and an end plate which is attached to the body portion by fasteners.

Preferably also, the fasteners used to attach the cylindrical body portion to the end plate make use of the same bores that are used to attach the cylinder block to the front casing.

Advantageously, one set of fasteners is used to attach the end plate to the cylindrical portion and a second set of fasteners is used to connect the cylindrical portion to the cylinder block. This means that the fasteners can be relatively short and therefore optimized with regard to their weight.

A further advantage of the front casing is that because the enlarged bridges of the pistons do not contact the inner wall surfaces of the recesses, these surfaces need not be precision worked. In this regard, unlike prior art configurations, for example that described in U.S. Pat. No. 6,325,509, a considerable gap can be left between the outer surface of the bridge. It is therefore sufficient for the inner wall surfaces of the front casing adjacent the recesses which support the projecting wings to be simply lathe-worked. Overall, the front casing can be formed either by mechanical working or by casting.

According to a second aspect of the present invention there is provided a piston for use in a swash of wobble plate compressor according to the first aspect of the invention comprising a piston body at one end, a foot portion at the other end, and a bridge which connects the piston body to the foot portion and which projects outwardly for location into an adjacent recess defined in a front casing of the compressor, the bridge being bending resistant and on at least one side being provided with a laterally projecting wing that can support the piston against an adjacent inner wall surface of the front casing to one side of the recess.

The wing preferably projects laterally from along the full length of the bridge and is preferably integrally formed with the bridge.

Preferably, the external profile of the enlarged bridge is fashioned with a diameter which is greater than the diameter of the outer external profile of the wing.

Preferably also, both sides of the bridge are symmetrically provided with a projecting wing.

The various aspects of the present invention will now be described by way of example with reference to the accompanying drawings.

DETAILED DESCRIPTION OF THE INVENTION

Figure 1:
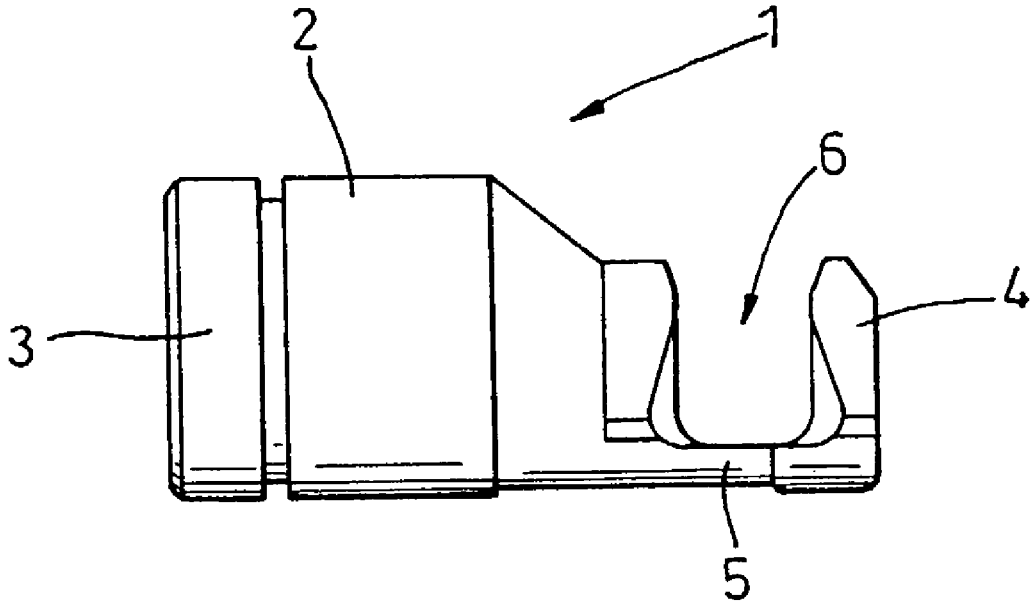
FIG. 1 is a side view of a conventional piston for use in a compressor according to the prior art.
Figure 1A:
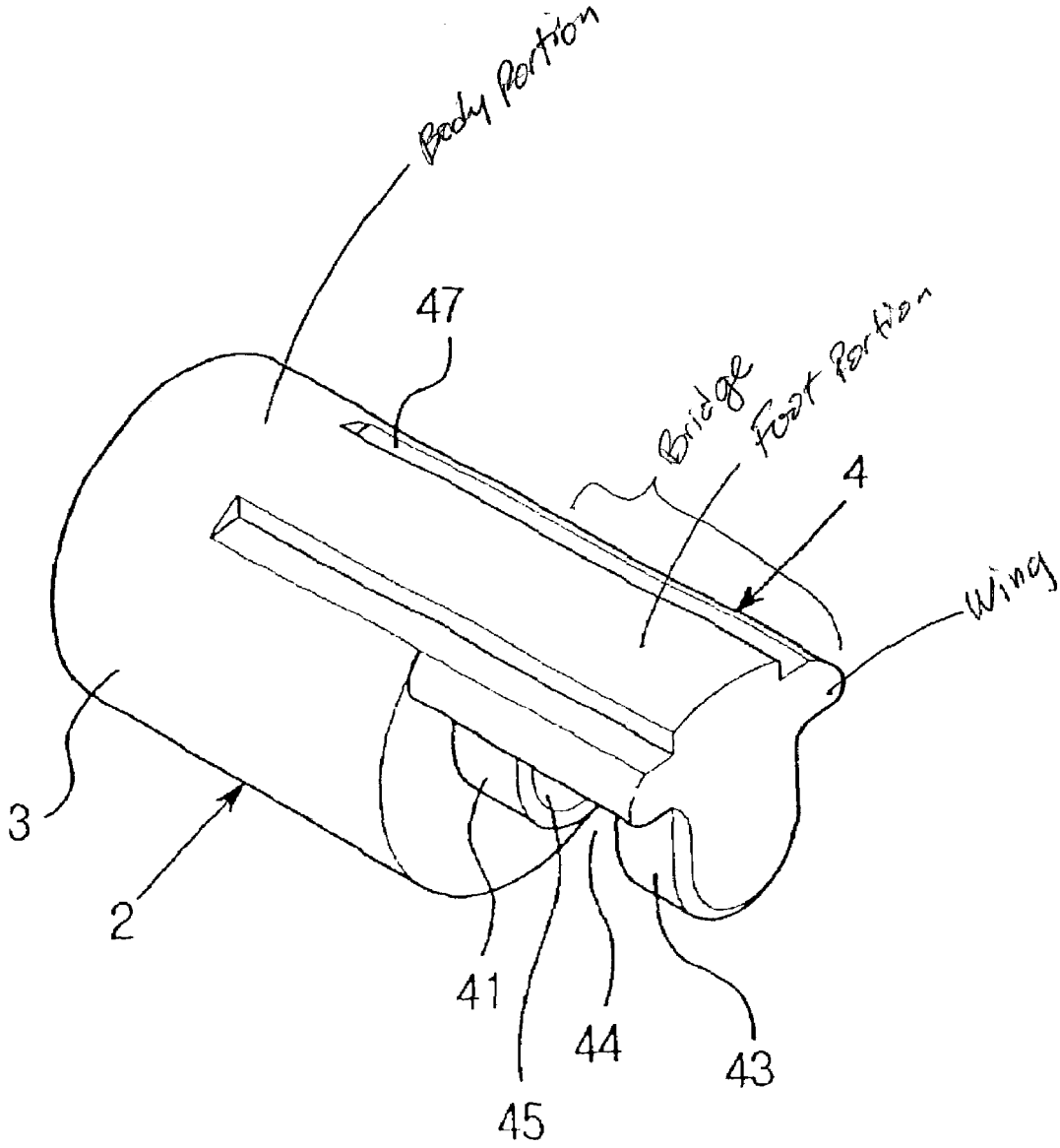
Figure 2:
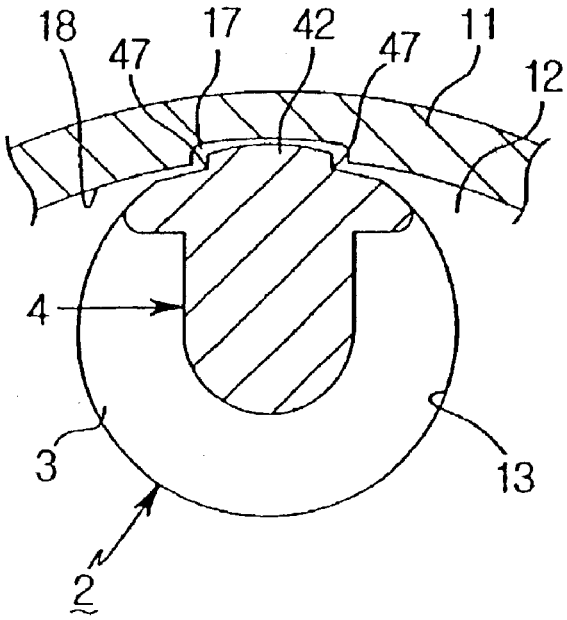
FIG. 2 is perspective, exploded view of a front casing for use in a compressor according to the first aspect of the present invention.

Referring firstly to FIG. 2, a front casing 10 for the use in a compressor according to the invention comprises a cylindrical portion 11 and an end plate 12 which is connected to the cylindrical portion by screw fasteners, as will be described. It will be appreciated, however, that the front casing could be made of unitary construction with cylindrical portion 11 and end plate 12 made in one piece in a "cup-shaped" design. Alternatively, end plate 12 could be welded to cylindrical portion 11 to provide the same effect.

Figure 3:
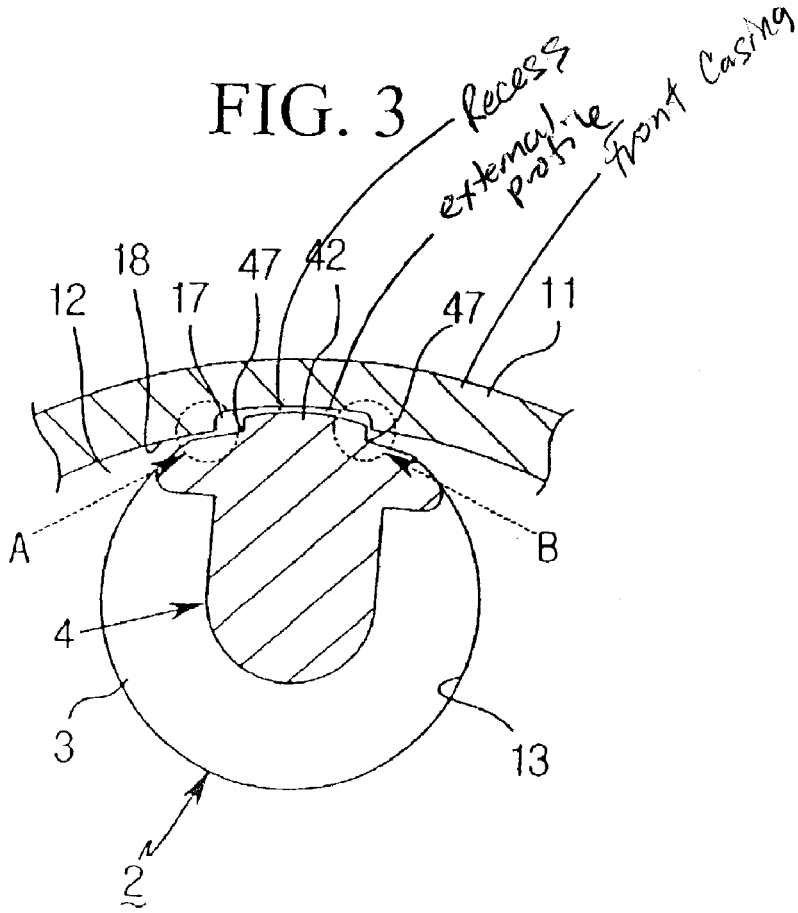
FIG. 3 is a perspective view of a piston according to the second aspect of the present invention for use in a compressor with a front casing as shown in FIG. 2.

Cylindrical portion 11 has an inner wall surface that has two different diameters and therefore defines a plurality of longitudinally extending recesses 13. Recesses 13 are equally distributed around the inner circumference of cylindrical portion 11 and their number corresponds to the number of pistons 14 (see FIGS. 3 and 4) to be accommodated in casing 10.

Wall surface 15*a* between recesses 13 defines the smaller of the inner diameters of front casing 10 and has the function of guiding and locking the pistons against rotation, as will be described with reference to FIG. 4. In contrast, the larger of the inner diameters of front casing 10 provided by wall surface 15*b* defining the bases of recesses 13 has the function of accommodating an enlarged bridge portion 16 of piston 14.

The relative widths of recesses 13 and wall surfaces 15*a* therebetween are governed by the position and number of pistons 14, the shape of enlarged bridge portion 16 and by the diameter of the swash or wobble plate arrangement, which determines the overall diameter of front casing 10.

Each of pistons 14 for use within front casing 10 comprises a cylindrical piston body 17 with a head portion 18 at one end, both for reciprocation in a cylinder bore 19 (see FIG. 5), and a foot portion 20 at its other end. A bridge 16 links foot portion 20 to cylindrical body 17 so that a recess (not shown but see recess 6 in FIG. 11) is defined between foot portion 20 and body 17 in which a bearing (not shown) of the swash or wobble plate arrangement is located. In the present invention, bridge 16 is enlarged to project outwardly opposite recess 13 with a curved cross-sectional profile 21 centered on the longitudinal axis of front casing 10. Bridge 16 is enlarged to strengthen this end of piston 14 against the bending moments that act on piston 14 during use of the compressor and is, therefore, bending resistant. As shown in FIG. 4, when pistons 14 are mounted in front casing 10, each piston 14 is located adjacent to one of recesses 13 so that enlarged bridge 16 projects outwardly into the apposed recess 13 and is thereby accommodated. It will be appreciated, however, that enlarged bridge 16 does not come into contact with the wall of recesses 13. Hence, the diameter of external profiles 21 of bridge 16 is greater than the smaller inner wall diameter of the front casing as defined by wall surfaces 15*a* but smaller than the larger inner wall diameter of the front casing as defined by wall surface 15*b*.

In addition to the aforementioned enlargement, bridge 16 of each piston 14 is also provided with at least one and preferably two laterally projecting symmetrical wings 22 that support piston 14 against adjacent wall surfaces 15*a* of the front casing to either side of recess 13. Wings 22 project from along the full length of the lateral sides of bridge 16 and are integrally formed therewith. However, wings 22 need not be made excessively thick as they will not be subjected to the bending moments which enlarged bridge 16 will be subjected to as they project outwards from the main body of bridge 16. This helps to keep the overall weight of the piston low. However, they can be made to project outwards on either side of piston 14 for significantly more than conventional anti-locking arrangements and still reduce significantly the friction generated by use of this feature because they do not contact the surfaces of recess 13. The overall projecting length of wings 22 is only limited by the width of the wings of adjacent pistons 14 and therefore by the overall diameter of front casing 10 itself.

Figure 4:
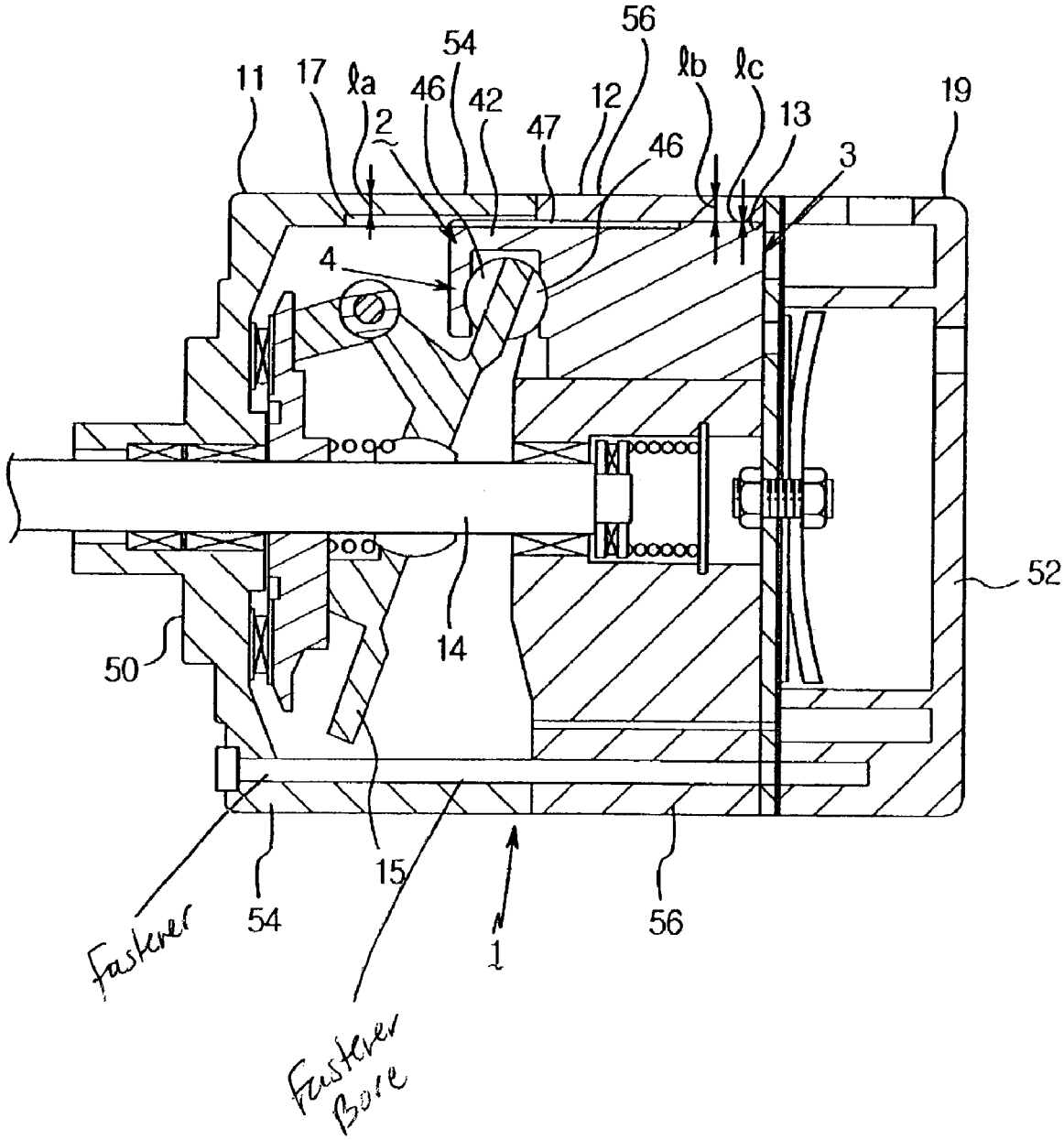
FIG. 4 is a schematic and view showing the interaction of the piston shown in FIG. 3 with the front casing shown in FIG. 2 in a compressor according to the invention.

As can be seen in FIG. 4, the diameter of outer external profiles 23 of wings 22 is substantially the same as the diameter of the adjacent wall surfaces 15*a* against which they are supported. Hence, the diameter of external profiles 21 of enlarged bridges 16 is greater than the diameter of these profiles 23.

In addition, as the requirement to provide a bonding resistant portion has been divided away from the requirement to provide an anti-rotation locking arrangement, the surfaces of recesses 13 no longer need to be contacted by bridge portion 16 and the thickness of front casing 10 in the region of recesses 13 is only governed by the pressure prevailing within front casing 10. Hence, a considerable gap can be left between external profiles 21 of bridges 16 of pistons 14 and wall surface 15*b* defining the bases of recesses 13. This reduces the weight of front casing 10.

Also, it will be appreciated that as no portion of piston 14 ever comes into contact with wall surfaces 15*b* at the bases of recesses 13 of front casing 10, that in the manufacture of front casing 10, these areas can be left unworked and only wall surfaces 15*a* need to be precision machined. Cylindrical portion 11 of front casing 10 can be made by mechanical working such as by drawing or pressing, but it can also be cast in order to provide for the attachment of further components of the compressor.

Figure 5:
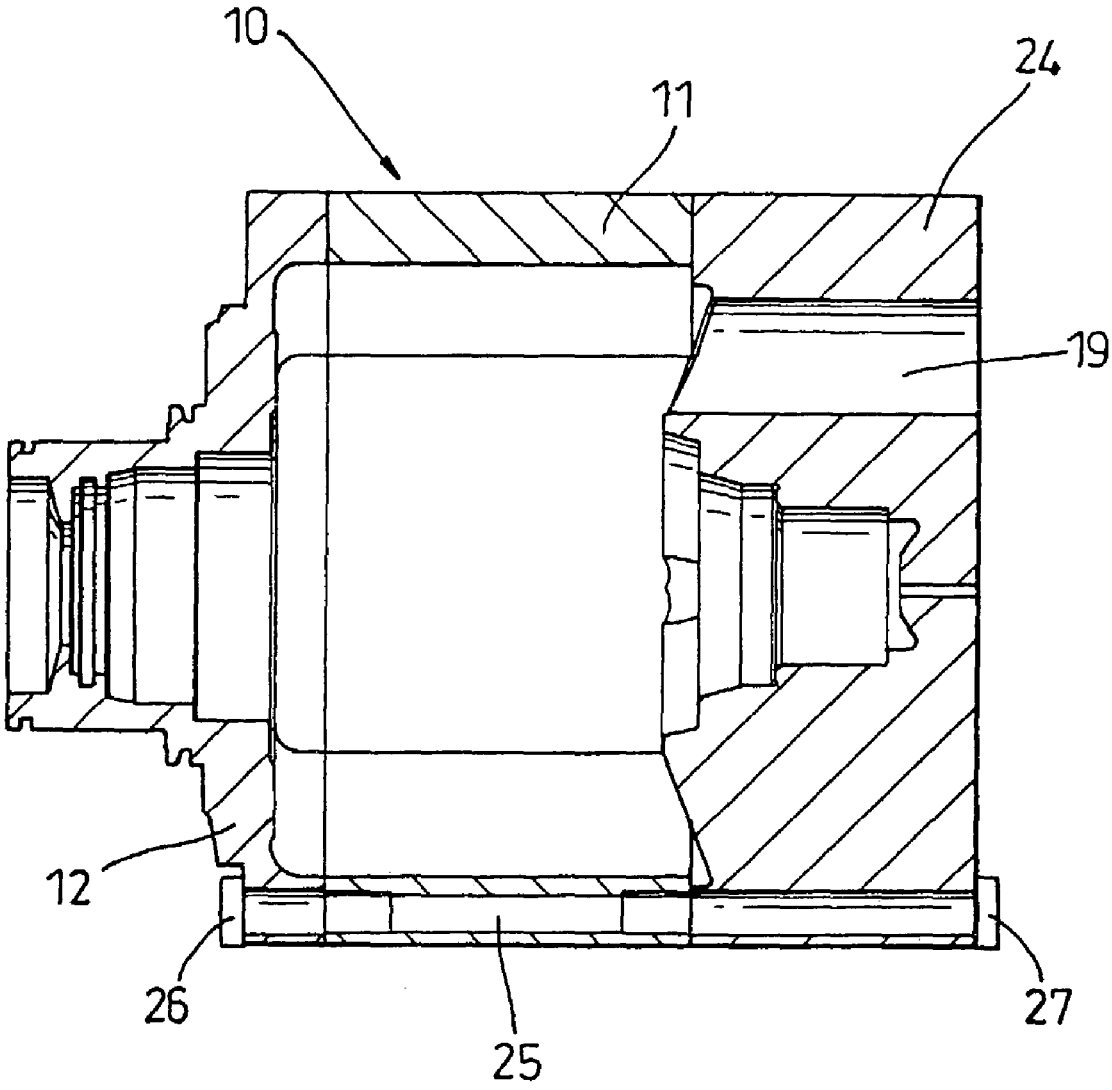
FIG. 5 is a cross-sectional view of a housing for a compressor according to the invention including the front casing shown in FIG. 2 and a cylinder block for connection to the front casing.

When assembled with other components of the compressor, front casing 10 is connected to a cylinder block 24 defining cylinder bores 19, as shown in FIG. 5. The thickened wall regions of front casing 10 between the recesses are suitable for the provision of bores 25 through which screw fasteners such as bolts 26, 27 can be located to attach front casing 10 to cylinder block 24. These fasteners may also be used to fasten end plate 12 to cylindrical portion 11 of front casing 10. Such an arrangement has several advantages. First, front casing 10 can be easily machined to provide necessary bores 25, which can extend completely through the portions of front casing 10 between recesses 13. Second, only short bolts need be used to fasten end plate 12 to cylindrical portion 11 and to fasten cylindrical portion 11 to cylinder block 24, a first set of bolts 26 being used for the former purpose and a second set of bolts 27 being used for the latter. This provides a significant weight reduction as regards the compressor as a whole. Third, as fasteners 26, 27 do not pass into the interior space of the compressor but only through the wall of the front casing 10, the heads of fasteners 26, 27 do not have to be sealed. In addition, this has the advantage that the overall diameter of front casing 10 does not have to be increased to accommodate fasteners 26, 27 as in prior art arrangements. Finally, the shortness of fasteners 26, 27 reduces any problems which may arise owing to differing rates of thermal expansion between the fasteners, front casing 10 and cylinder block 24.

It will be appreciated that as no portion of piston 14 ever comes into contact with wall surfaces 15*b* at the bases of recesses 13 of front casing 10, that in the manufacture of front casing 10, these areas can be left unworked and only wall surfaces 15*a* need to be precision machined. In fact, the depth of recesses 13 are calculated so that a constant stress distribution is achieved over the casing circumference on alternating recesses 13 and bores 25. Cylindrical portion 11 of front casing 10 can be made by mechanical working such as by drawing or pressing, but it can also be cast in order to provide for the attachment of further components of the compressor.

Suitable combinations of materials for the manufacture of front casing 10 and piston 14 are steel-steel, aluminum-steel, and aluminum-aluminum.

Overall therefore, it will be appreciated that the invention enables the compressor to be designed with an optimum use of space to produce a compact, weight-efficient design. Front casing 10 is simple and inexpensive to manufacture and owing to its design allows a frictionally optimized movement of pistons 14 to produce the required anti-rotation locking.

What is claimed is:

1. A piston assembly for use in a compressor comprising at least one piston provided with a piston body at one end and a foot portion at its other end;

a front casing with an inner wall surface defining a longitudinally extending recess in a position apposed to said piston;

the piston body and the foot portion of said piston being connected by a bridge that is being resistant and projects outwardly into the apposed recess; and said bridge having a pair of symmetric wings with each of said wings projecting laterally from along the full length of each side of the bridge of said piston, the diameter of the external profile of said wings being substantially the same as the diameter of the adjacent inner wall so that said wings are in contact with and are supported by said inner wall cooperating to support and lock said piston against the adjacent inner wall surface of the front casing without said bridge contacting said inner wall surface defining said recess and with said wings disposed to one side of the recess.

2. A piston assembly as claimed in claim 1, wherein the external profile of the bridge has a diameter greater than the diameter of the outer external profile of the wing.

3. A piston assembly as claimed in claim 2, wherein the diameter of the external profile of the bridge is centered in the longitudinal axis of the front casing.

4. A piston assembly as claimed in claim 1, wherein the diameter of the external profile of the bridge is greater than the smaller inner wall diameter of the front casing.

5. A piston assembly as claimed in claim 1, wherein the portions of the front casing between the recesses are provided with longitudinally extending bores in which fasteners can be located to attach the front casing to the cylinder block.

6. A piston assembly as claimed in claim 1, wherein the front casing comprises at least two separate but interconnected portions.

7. A piston assembly as claimed in claim 6, wherein the front casing comprises a hollow cylindrical body portion and an end plate which is attached to the body portion by fasteners.

8. A piston assembly as claimed in claim 7, wherein the fasteners used to attach the cylindrical body portion to the end plate use the same bores used to attach the cylinder block to the front casing.

9. A piston assembly as claimed in claim 8, wherein one set of fasteners is used to attach the end plate to the cylindrical portion and a second set of fasteners is used to connect the cylindrical portion to the cylinder block.

10. A piston assembly as claimed in claim 1, wherein the front casing is of a unitary "cup-shaped" construction.

11. A piston assembly as claimed in claim 1, wherein the inner wall surfaces of the front casing adjacent the recesses which support the projecting wings of the pistons are precision machined.

12. A piston assembly as claimed in claim 1, wherein the front casing is formed by at least one of mechanical working and casting.

13. A piston assembly as claimed in claim 1, wherein said wings are integrally formed with the bridge.

* * * * *